US010546548B2

(12) United States Patent
Cheng et al.

(10) Patent No.: US 10,546,548 B2
(45) Date of Patent: Jan. 28, 2020

(54) SELF-REFRESH DISPLAY DRIVING DEVICE, DRIVING METHOD AND DISPLAY DEVICE

(71) Applicants: BOE TECHNOLOGY GROUP CO., LTD., Beijing (CN); Hefei BOE Optoelectronics Technology Co., Ltd., Anhui (CN)

(72) Inventors: Lv Cheng, Beijing (CN); Tao Ma, Beijing (CN)

(73) Assignees: BOE TECHNOLOGY GROUP CO., LTD., Beijing (CN); HEFEI BOE OPTOELECTRONICS TECHNOLOGY CO., LTD., Anhui (CN)

( * ) Notice: Subject to any disclaimer, the term of this patent is extended or adjusted under 35 U.S.C. 154(b) by 29 days.

(21) Appl. No.: 15/809,001

(22) Filed: Nov. 10, 2017

(65) Prior Publication Data

US 2018/0308439 A1 Oct. 25, 2018

(30) Foreign Application Priority Data

Apr. 21, 2017 (CN) ..... 2017 1 0266627

(51) Int. Cl.
*G09G 3/36* (2006.01)

(52) U.S. Cl.
CPC ..... *G09G 3/3618* (2013.01); *G09G 2330/021* (2013.01); *G09G 2360/18* (2013.01)

(58) Field of Classification Search
CPC ..... G09G 3/3618; G09G 3/2096; G09G 2320/103; G09G 2330/021; G09G 2360/18
USPC ..... 345/212
See application file for complete search history.

(56) References Cited

U.S. PATENT DOCUMENTS

2011/0242088 A1* 10/2011 Kim ..... G09G 3/3611 345/214
2012/0086737 A1 4/2012 Tanaka
2012/0146968 A1* 6/2012 Glen ..... G09G 5/003 345/204

FOREIGN PATENT DOCUMENTS

CN 103943052 A 7/2014
CN 103971647 A 8/2014

OTHER PUBLICATIONS

First Office Action for Chinese Patent Application No. 2017102666275 dated Dec. 5, 2018.

* cited by examiner

*Primary Examiner* — Amare Mengistu
*Assistant Examiner* — Gloryvid Figueroa-Gibson
(74) *Attorney, Agent, or Firm* — Calfee, Halter & Griswold LLP

(57) ABSTRACT

The present disclosure provides a self-refresh display driving device, a driving method and a display device. The self-refresh display driving device includes a timing control module and a driving module, wherein the driving module includes a frame buffer. The timing control module enters a sleep mode when the self refresh display driving device enters the self-refresh mode.

12 Claims, 3 Drawing Sheets

SELF-REFRESH DISPLAY DRIVING DEVICE, DRIVING METHOD AND DISPLAY DEVICE

CROSS-REFERENCE TO RELATED APPLICATIONS

This application claims the benefit of the priority of the Chinese Patent Application No. 201710266627.5, filed on Apr. 21, 2017, the entire contents of which are hereby incorporated by reference.

TECHNICAL FIELD

The present disclosure relates to display technology, and more particularly to a self-refresh display driving device, a driving method and a display device.

BACKGROUND

With the development of liquid crystal display technology, there is a demand for lower power consumption of the liquid crystal display panel and thus more and more power saving technology are employed in the liquid crystal display panel. One of the most widely used low-power technology is PSR (Panel Self Refresh) technology. The existing PSR technology may reduce the power consumption of the system side significantly, but has limited effect in reducing the power consumption of the display panel side.

Therefore, there is still room for improvement in the existing technical solution.

It is noted that the information disclosed in the above-mentioned background section is for the purpose of facilitating the understanding of the background of the present disclosure only and may therefore include information that does not constitute prior art known to those skilled in the art.

SUMMARY

It is an object of the present disclosure to provide a self-refresh display driving device, a driving method and a display device.

Other features and advantages of the present disclosure will become apparent from the following detailed description, or in part, by practice of the present disclosure.

According to an aspect of the present disclosure, there is provided a self-refresh display driving device including: a timing control module and a driving module, wherein the driving module includes a frame buffer, and when the self-refresh display driving device enters the self-refresh mode, the timing control module enters a sleep mode.

According to an aspect of the present disclosure, there is provided a method of driving a self-refresh display device which includes a self-refresh display driving device having a timing control module and a driving module, the method comprising:

controlling the self-refresh display driving device to enter a self-refresh mode when it is determined that a static image needs to be displayed; and controlling the timing control module to enter a sleep mode when the self-refresh display driving device enters the self-refresh mode.

According to an aspect of the present disclosure, there is provided a display device including: a self-refresh display driving device as described above.

It is appreciated that both the foregoing general description and the following detailed description are exemplary and explanatory only and do not limit the disclosure.

This section provides an overview of the various implementations or examples described in this disclosure and is not intended to be exhaustive of the full scope or all features of the disclosed technology.

BRIEF DESCRIPTION OF THE DRAWINGS

The drawings herein are incorporated into and constitute a part of this specification, showing embodiments consistent with the present disclosure and serving to explain the principles of the present disclosure together with the specification. Apparently, the drawings described below are merely examples of the present disclosure and other different drawings may be obtained by those skilled in the art without inventive work.

DETAILED DESCRIPTION

Figure 1:
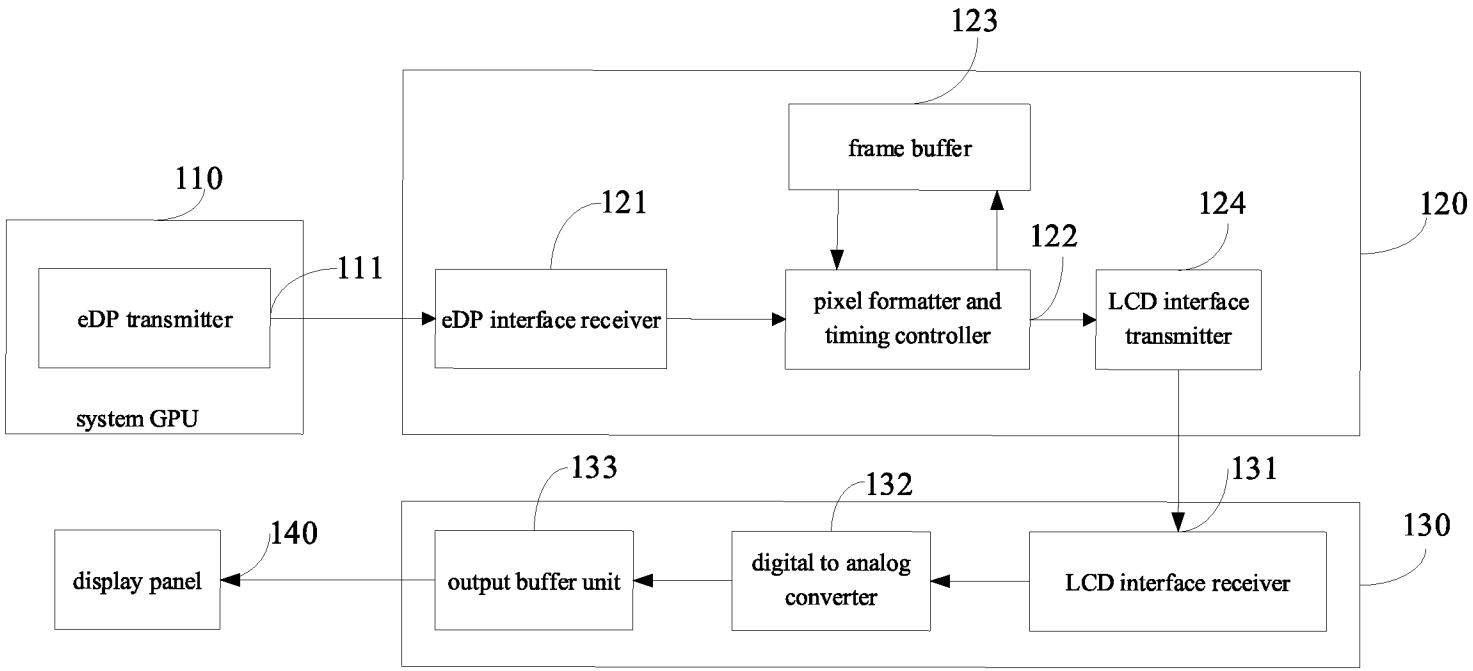
FIG. 1 schematically illustrates a PSR circuit design according to an embodiment of the present disclosure.

Exemplary embodiment will be described more fully with reference to the accompanying drawings. However, the exemplary embodiments may be embodied in many forms and should not be considered as limited to the examples set forth herein. The features, structures, or characteristics described may be incorporated in one or more embodiments in any suitable manner. In the following description, numerous specific details are set forth to give a full understanding of the embodiments of the present disclosure. However, those skilled in the art will appreciate that in practicing the technical solution of the present disclosure one or more of the particular details may be omitted or other methods, components, devices, steps, and the like may be employed.

It is to be noted that, in the drawings, the dimensions of the layers and regions may be exaggerated for clarity of illustration. It is appreciated that when an element or a layer is referred to as being "on" another element or layer, it may be directly on the other element, or there may be an intermediate layer. In addition, it is appreciated that when an element or a layer is referred to as being "under" another element or layer, it may be directly under other elements, or there may be more than one intermediate layer or element. Additionally, it is also appreciated that when a layer or element is referred to as being "between" two layers or two elements, it may be a single layer between two layers or two elements, or there may be more than one intermediate layer or components. Similar reference numbers indicate similar elements through the description.

The traditional display panel usually has a refresh rate of 60 Hz. In fact, the images displayed by the display panel are static. The reason why the user can see dynamic images is the display panel has high refresh rate. In the process of continuous refresh, the image data transmission from the memory to the panel is carried out by the system GPU. The process needs to be repeated 60 times per second. In practice, the amount of the image data varies according to different applications. For example, in the case where a user is reading an e-book in which the background is not changed with only the text changed, the data refresh for the whole panel is a waste. In this case, the GPU which is responsible for the data processing has to work continuously and thus has high power consumption. In order to solve this problem, the PSR (Panel Self refresh) technology is adopted in which the data corresponding to the static image in a frame buffer (e.g., a PSR frame buffer) is copied to the memory of the display panel so as to save energy.

As shown in FIG. 1, in one PSR circuit design method, the PSR function is implemented through the PSR frame buffer 123 in the timing control module (Tcon) 120. Specifically, after the system GPU 110 enters the self refresh mode (e.g., the PSR mode), the data of the last frame is transmitted to the timing control module (Tcon) 120, the interface (e.g., an eDP) transmitter 111 is turned off, and the interface main link is disconnected. After the interface receiver 121 in the timing control module (Tcon) 120 receives the data of the last frame, the interface data is stored frame buffer 123 and the interface receiver 121 in the timing control module (Tcon) 120 is turned off, and then the eDP data is converted, by means of a pixel formatter and a timing controller 122, into interface data (for example, LCD Interface data, although the liquid crystal display is taken as an example to describe the embodiments according to the present disclosure, the present disclosure is not limited to the specific display panel type). The interface data is transmitted to the driving module 130 (e.g., a driver integrated circuit, hereinafter referred to as "driver IC") by the LCD interface transmitter 124 in the timing control module (Tcon) 120. The LCD interface receiver 131 in the driver IC 130 receives the LCD Interface data, and then the digital to analog converter 132 converts the LCD Interface data into an analog signal which is transmitted to the display panel 140 by an output buffer unit 133. The display panel 140 displays the images after the system enters the PSR mode.

However, in the above PSR circuit design, the PSR Frame buffer 123 is configured in the timing control module (Tcon) 120. After entering the PSR mode, the timing control module (Tcon) 120 turns off only the interface receiver 121, but the PSR frame buffer 123 is remained on. Therefore, in the self-refresh display mode (PSR mode), although the power consumption in the system side is reduced, the power consumption of the display panel 140 circuit is not reduced significantly, sometimes even increased after entering the PSR mode since some of the frame buffer 123 in the timing control module (Tcon) 120 has a higher power consumption than the interface receiver 121.

In another embodiment of the present disclosure, there is provided an improved PSR circuit design, in which the PSR frame buffer is configured in the driver IC. After entering the PSR mode, the Tcon may enter a sleep mode, turning off the interface receiver and LCD interface transmitter. The Tcon only needs to output an enable signal (PSR EN) to the driver IC and thus can reduce its power consumption significantly. On the other hand, the LCD interface receiver may also be turned off through the driver IC so as to reduce part of the power consumption and realize low power consumption effect in the display panel circuit under the PSR mode. This will be described below by way of embodiments.

Figure 2:
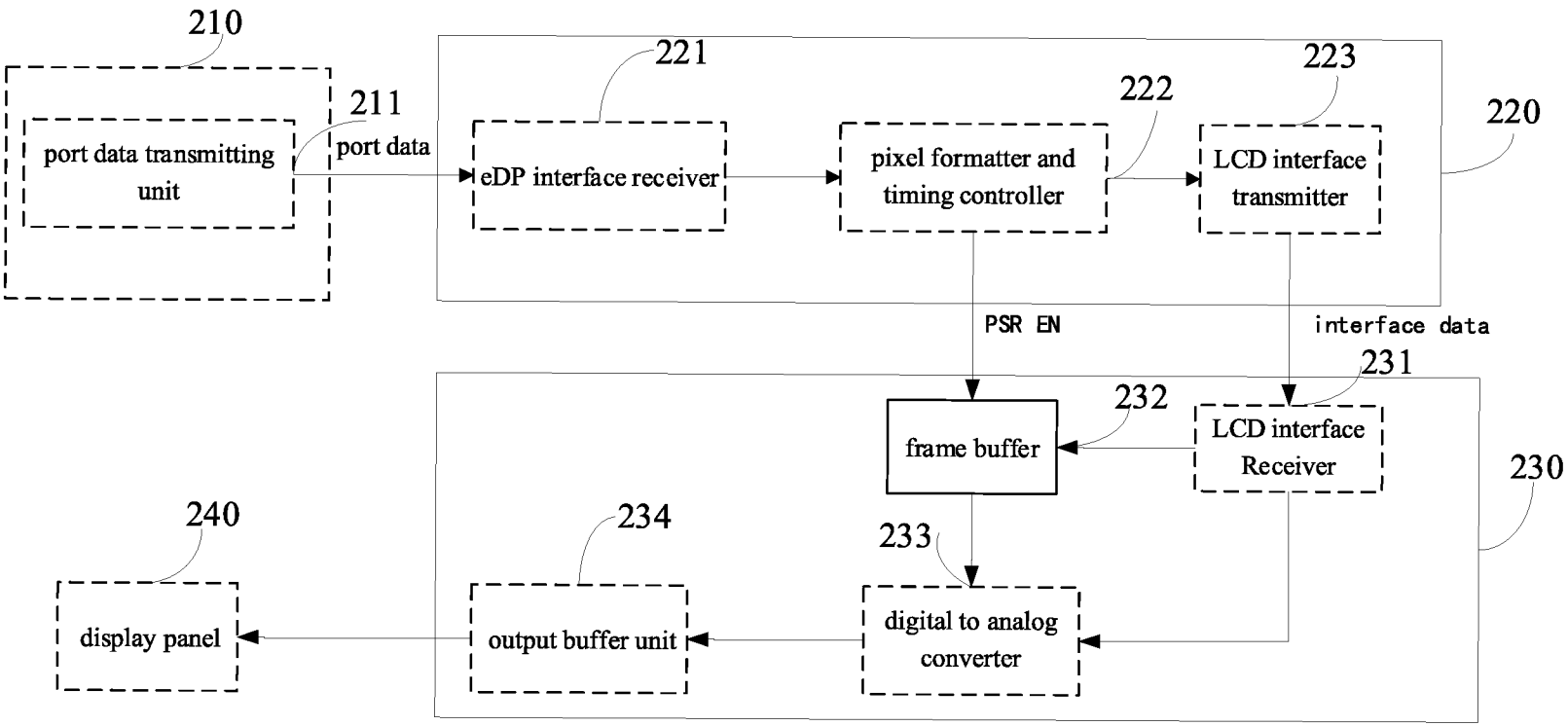
FIG. 2 schematically illustrates a self-refresh display driving device according to an exemplary embodiment of the present disclosure.

As shown in FIG. 2, a self-refresh display driving device includes a timing control module (Tcon) 220 and a driving module (e.g., a driver integrated circuit, hereinafter referred to as "driver IC") 230. The driver IC 230 includes a PSR frame buffer 232. When self refresh display driving device enters a PSR mode, the timing control module (Tcon) 220 enters a sleep mode.

Hereinafter, individual portions of the self-refresh display driving device in the present exemplary embodiment will be described in more detail.

As shown in FIG. 2, in an exemplary embodiment, the timing control module (Tcon) 220 may further include a port data receiving unit (interface receiver) 221, a pixel formatter 222, a timing controller 222 and an interface data transmission unit (LCD interface transmitter) 223.

As shown in FIG. 2, in an exemplary embodiment, the self-refresh display driving device is connected to a display control device 210 (e.g., a system GPU). When the self-refresh display driving device enters the PSR mode, the display control device 210 transmits the last frame to the interface receiver 221 of the timing control module (non) 220 through the port data transmitting unit (for example, eDP transmitter) 211 included in the display control device 210 and then disconnects the main link.

In an exemplary embodiment, the pixel formatter 222 is connected to the port data receiving unit (eDP Receiver) 221 and the interface data transmitting unit (e.g., LCD interface transmitter) 223, respectively. The pixel formatter 222 is configured to convert the port data into interface data of a predetermined format (e.g., LCD Interface data).

In general, the port data transmitted by the system GPU includes various kinds of control signals (e.g., gate drive control signals, timing control signals, etc.) and pixel data for the display regions of the display panel. The control signals and the pixel data in the port data are separated from each other by the pixel formatter. The interface data herein refers to the pixel date extracted from the port data.

When the self-refresh display driving device enters the PSR mode, the timing control module (Tcon) 220 turns off the interface receiver 221, the pixel formatter 222 and the interface data transmission unit (LCD interface transmission) 223. That is, the timing control module (Tcon) 220 enters the sleep mode. Thus, the power consumption of the Tcon may be reduced significantly after entering the PSR mode.

As shown in FIG. 2, in an exemplary embodiment, the driver IC 230 may further include an interface data receiving unit (LCD interface Receiver) 231, which is connected to the interface data transmission unit (LCD interface transmitter) 223 in the timing control module (Tcon) 220 and receives the interface data transmitted from the LCD interface transmitter.

In an exemplary embodiment, for example, interface data may be transmitted in the way of Mini-LVDS or p2p between the LCD interface transmitter 223 and the LCD interface receiver 231, but this disclosure is not limited thereto.

In an exemplary embodiment, while the LCD interface transmitter 223 transmits the interface data to the LCD interface receiver 231, the timing controller 222 transmits an enable signal (e.g., the PSR EN) of a first level (e.g., a high level, but is not limited in this disclosure, and may also be a low level in the other embodiments) to the PSR frame buffer 232.

When the PSR frame buffer 232 receives the enable signal (PSR EN) of the first level transmitted by the timing controller 222 in the timing control module (Tcon) 220, the LCD interface receiver 231 in the driver IC 230 receives the interface data transmitted by the LCD interface transmitter 223 in the timing control module (Tcon) 220, and stores the interface data in the PSR frame buffer 232.

In an exemplary embodiment, in order to further reduce the power consumption, after the interface data is stored to the PSR frame buffer 232, the driver IC 230 turns off the LCD interface receiver 231.

In an exemplary embodiment, the drive IC 230 is connected to a display panel 240 (e.g., an LCD display panel). The driver IC 230 may further include a digital to analog converter 233. After the LCD interface receiver 231 stores the interface data into the frame PSR frame buffer 232, the digital to analog converter 233 reads out the interface data in the PSR frame buffer 232 and converts the data into an analog signal, and then the analog signal is transmitted to the display panel 240 for display.

In an exemplary embodiment, the self-refresh display driving device includes a plurality of driver ICs 230. The PSR frame buffer 232 is distributed into the plurality of driver ICs 230. For example, it is assumed that the self-refresh display driving device has four driver ICs 230, each of which includes a PSR frame buffer. When interface data of one frame of a complete picture is received from the system GPU, it is divided into the interface data corresponding to four display regions of the display panel. Then the divided interface data corresponding to four display regions are respectively input into the PSR frame buffers of the four driver ICs 230. It should be noted that the four driver ICs herein are for illustrative purposes only and are not intended to limit the present disclosure. The number of the driver ICs may be selected depending on the application scenarios. In this way, by dividing the PSR frame buffer from the Tcon into each of the driver ICs, the package of the Tcon for supporting the PSR may be small, which may facilitate the miniaturization of the PCB.

In the self-refresh display driving device disclosed in the present disclosure, when the system GPU enters the PSR mode, the eDP transmitter of the GPU transmits the data of the last frame, and then disconnects the eDP main link. After the interface receiver in the Tcon receives the last frame of the data, the eDP data is converted into LCD Interface data, which is transmitted to the driver IC through LCD interface transmitter in the Tcon. Meanwhile, a PSR EN enable signal of high-level is transmitted to the driver IC, and the interface receiver and LCD interface transmitter in the Tcon is turned off. The driver IC receives the LCD interface data of the last frame and then enters the PSR mode. The data is stored into the PSR frame buffer and the LCD interface receiver is turned off. The digital to analog converter reads out the data in the PSR frame buffer then converts it into analog signal which is transmitted to the display panel. The display panel shows the images after the system enters the PSR mode. In the improved PSR circuit design according to the present embodiment, the PSR frame buffer is located in the driver IC. In this way, after entering the PSR mode, the Tcon may enter the sleep mode with the interface receiver turned off and only need to output the enable signal (PSR EN), so that the Tcon can reduce the power consumption significantly. On the other hand, the driver IC may also turn off the LCD interface receiver so as to further reduces the power consumption. On the whole, the improved PSR circuit design can reduce power consumption, so that the panel may work under the PSR mode with low power consumption.

In the exemplary embodiment, when the self-refresh display driving device exits the self-refresh mode and enters normal display mode, the display control device 210, e.g., the system GPU, sends a waken-up signal to the timing control module 220 to waken up the timing control module 220, receives the port data of the next frame, converts the port data into interface data of a predetermined format and transmits the interface data to the diver 230. Meanwhile a enable signal (PSR EN) of a second level (e.g., low level, but that is not limited in the present disclosure) is transmitted to the PSR frame buffer 232 so as to turn off the PSR frame buffer 232. At this time, the e a digital to analog converter 233 reads out the interface data of the corresponding picture directly from the LCD interface receiver 231 to perform digital-to-analog conversion.

For example, after the system GPU exits the PSR mode, the eDP transmitter is turned on, the Tcon is waken up, and the data of the next frame is sent to the Tcon. The Tcon turns on the eDP main link, receives the data of the next frame, converts the eDP data into the LCD Interface data, turns on the LCD interface transmitter, transmits the LCD Interface data to the driver IC, and sends a PSR EN (low) to the driver IC. The driver IC turns on the LCD interface receiver, turns off the PSR frame buffer and receives the LCD Interface data of the next frame. The digital to analog converter converts the LCD Interface data into an Analog signal to the panel. The panel displays the next image.

In addition, in other exemplary embodiments of the present disclosure, the self-refresh display driving device further includes other components. Thus, the technical solution with added structures also falls within the scope of the present disclosure.

Further, the embodiments of the present disclosed also provide a driving method of driving a self refresh display driving device as described in the above embodiment. The driving method includes: controlling the self-refresh display device (i.e., the self-fresh display driving device) to enter a PSR mode when it is determined that a static image needs to be displayed.

Figure 3:
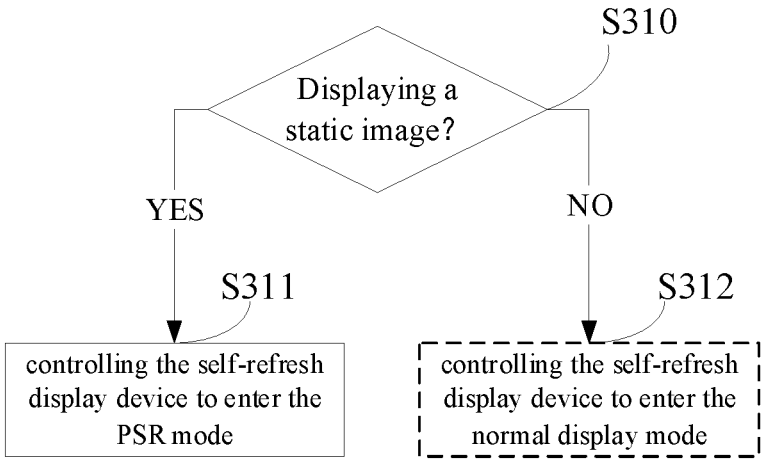
FIG. 3 schematically illustrates a flow chart of a driving method according to an exemplary embodiment of the present disclosure.

As shown in FIG. 3, the driving method may include the following steps:

Step S310: determining whether a static image needs to be currently displayed; when a static image needs to be displayed, proceeding to step S311; when a static image needs not to be displayed, proceeding to step S312.

In some display scenes, such as the cases where the user is reading articles, viewing pictures, or chatting, the images displayed on the screen generally continue for a period of time, during which the image displayed by the display device a static image. That is, the image date transmitted from the mainboard circuit to the driving chip of the display device are the same. Therefore, if the driving chip is configured to refresh the displayed images automatically based on the obtained image data, the mainboard circuit need not to transmit image data to the driving chip of the display screen, thereby reducing the power consumption.

S320: controlling the self-refresh display driving device is to enter the PSR mode.

When a static image is displayed, by triggering the self-refresh display driving device to enter the PSR mode (such as by means of a specific trigger signal, such as the enable signal PSR EN enabling the self-refresh display driving device to enter into the PSR mode), the self-refresh display driving device may self-refresh the images with no need to send image signal through the mainboard circuit, thereby reducing power consumption.

Controlling the self-refresh display driving device into the PSR mode may include the following steps:

After the system GPU enters the PSR mode, it sends the data of the last frame to the Tcon, turns off the eDP transmission and disconnects the eDP main limb.

The display device periodically refreshes the displayed image. In a general display device, a driving device, for example, a display driver integrated chip, receives the image data to be displayed from a graphic processing unit (GPU) or a display related circuit of a control display device. Based on the received image data, the timing controller in the driving device instructs and controls the source driver and the gate driver in a driving device to apply an appropriate voltage to the pixels in the display panel of the display device to display images.

After the interface receiver in the Tcon receives the data of the last frame, it converts the eDP data into LCD Interface data, transmits it to the driver IC through the LCD interface transmitter in the Tcon, sends a PSR EN (high) to the driver IC, and then turns off the Tcon interface receiver and the LCD interface transmitter.

After the driver IC receives the LCD interface data of the last frame, it enters the PSR mode, stores the data into the PSR frame buffer and turns off the LCD interface receiver unit. The digital to analog converter reads out the data in the PSR frame buffer and converts it into analog signal to the panel. The panel shows the images of the system after it enters the PSR mode.

In an exemplary embodiment, the method may further include a step S312 controlling the self-refresh display driving device to enter the normal display mode.

The normal display mode here is relative to the self-refresh mode, and is configured to generate corresponding pixel voltage based on the received image signal and applies the pixel voltage to the access terminals of respective connected data lines to turn on them in order during the normal display mode. In this way, it is possible to enable the driving device to display dynamic images. The preferred embodiments provided by the present disclosure should not be considered as limiting the scope of the present disclosure.

In practice, the method of implementing the normal display mode herein can be made with reference to the display driving device design for refreshing the display panel in the prior art, which is not described in detail herein.

In the case where the normal display mode is included, control is required to switch between the normal display mode and the self-refresh mode. In practice, such a process can be achieved through a variety of structures. In the embodiment of the present disclosure (see FIG. 2), the switching between the normal display mode and the self-refresh mode can be controlled by the high or low levels of the enable signal PSR EN. When the system GPU determines that a static image needs to be displayed, it sends the image data of the last frame to Tcon, and then disconnects the main link. Meanwhile, the timing controller in the Tcon triggers an enable signal PSR EN of preset level (e.g., high) based on the disconnection of the main link to the driver IC to turn on the PSR frame buffer to enter the PSR mode. On the contrary, when the system GPU determines that a dynamic image needs to be displayed, it wakens up Tcon, triggers the timing controller correspondingly to send an enable signal PSR EN of for example low-level to driver IC, turns off the PSR frame buffer and enters the normal display mode.

In the driving method provided by the embodiments of the present disclosure, when the system enters the PSR mode, the LCD interface transmitter in the Tcon and the LCD interface Receiver in the driver IC are turned off, thereby effectively saving the power consumption caused by the signal data transmission in the Tcon and driver IC, thereby reducing overall power consumption of the circuit. Additionally, the circuit and the method of realizing the same are simple and effective.

In addition, the specific details of the steps in the above-described driving method have been described in detail in the corresponding self-refresh display driving device. Therefore, the description thereof will not be repeated here. Moreover, although the various steps of the method of the present disclosure have been described in a particular order in the drawings, it is not intended or implied that the steps must be performed in that particular order or all the steps shown must be performed to achieve the desired result. Additionally or optionally, some steps may be omitted, multiple steps may be combined into one step, and/or a step may be decomposed into multiple steps.

Figure 4:
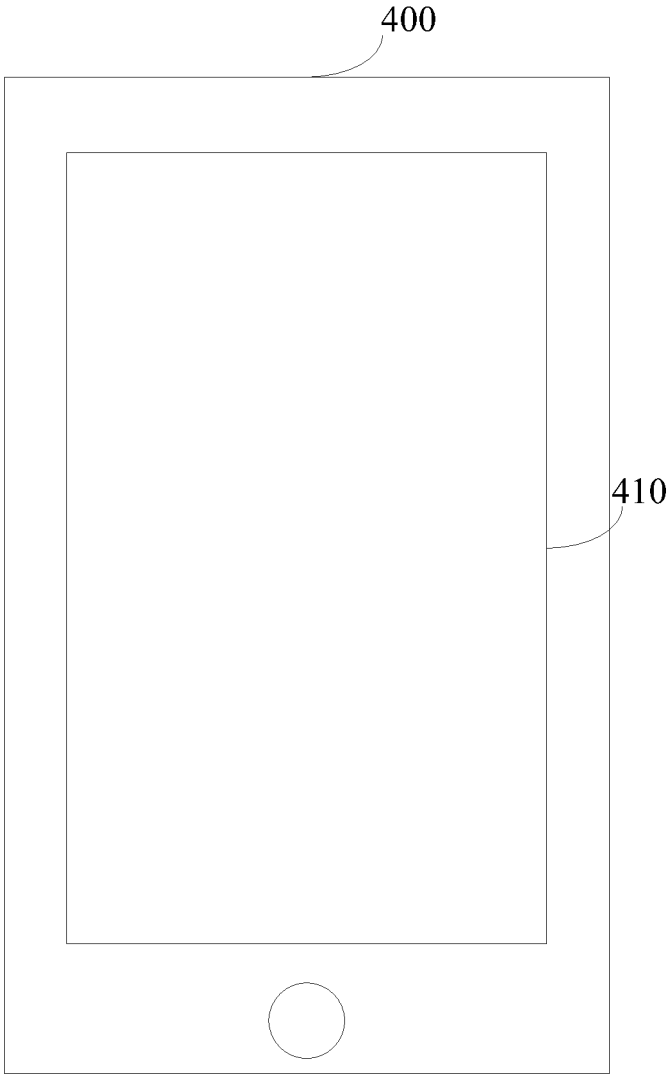
FIG. 4 schematically illustrates a display device according to an exemplary embodiment of the present disclosure.

Further, as shown in FIG. 4, the present disclosure also provides a display device 400 including a self-refresh display driving device as described in the above embodiments.

The display device 400 may be any product or component having a display function such as a display panel, a mobile phone, a tablet computer, a television set, a laptop computer, a digital photo frame, a navigator, or the like.

As shown in FIG. 4, the display device 400 may also include a display panel 410. The display panel 410 may be a flat display panel such as a plasma panel, an organic light emitting diode (OLED) panel or a thin film transistor liquid crystal display (TFT LCD) panel.

Since the display device provided in the present disclosure includes the above-described self-refresh display driving device, the same technical problem can be solved and the same technical effects can be obtained, which will not be repeated herein.

In the self-refresh display driving device according to one embodiment of the present disclosure, the PSR frame buffer is set in the driver IC. In this way, the timing control module may enter the sleep mode after entering the self-refresh mode. On one hand, the power consumption of the timing control module can be reduced. On the other hand, the power consumption of the display panel in the self-refresh mode can be also reduced accordingly.

Other embodiments of the present disclosure will be readily apparent to those skilled in the art upon consideration of the specification and practice of the disclosure herein. This application is intended to cover any variations, uses, or adaptations of the present disclosure that follow the general principles of the present disclosure and include the common general knowledge or conventional techniques disclosed in this disclosure without departing from the present disclosure the specification and examples are to be regarded as illustrative only, and the true scope and spirit of the disclosure is indicated by the appended claims.

What is claimed is:

1. A self-refresh display driving device comprising: a timing control module and a driving module, wherein the driving module comprises a frame buffer, and when the self-refresh display driving device enters a self-refresh mode, the timing control module enters a sleep mode, wherein the timing control module comprises a first interface receiver, a pixel formatter, a timing controller, and an interface transmitter, when the self-refresh display driving device enters the self-refresh mode, the timing control module turns off the first interface receiver, the pixel formatter, and the interface transmitter, wherein the driving module further comprises a second interface receiver, wherein the second interface receiver is connected to the interface transmitter, when the frame buffer receives an enable signal of a first level, the second interface receiver receives interface data transmitted by the interface transmitter and stores it in the frame buffer, and wherein after the interface data is stored in the frame buffer, the driving module turns off the second interface receiver, wherein when the self-refresh display driving device exits the self-refresh mode, the timing control module receives a waken-up signal and is wakened up to receive port data of the next frame, the port data is converted into interface data of a predetermined format which is transmitted to the driving module, and an enable signal of a second level is transmitted to the frame buffer to turn off the frame buffer.

2. The self-refresh display driving device according to claim 1, wherein the self-refresh display driving device comprises a plurality of driving modules, wherein the frame buffer is divided into the plurality of driving modules.

3. The self-refresh display driving device according to claim 1, wherein the self-refresh display driving device is connected to a display control device, wherein when the self-refresh display driving device enters the self-refresh mode, the display control device disconnects an interface main link after sending port data of a last frame to the first interface receiver.

4. The self-refresh display driving device according to claim 3, wherein the pixel formatter is connected to the first interface receiver and the interface transmitter respectively, and the pixel formatter is configured to convert the port data into interface data of a predetermined format.

5. The self-refresh display driving device according to claim 4, wherein while the interface transmitter transmits the interface data to the second interface receiver, the timing controller sends an enable signal of the first level to the frame buffer.

6. The self-refresh display driving device according to claim 1, wherein the driving module is connected to a display panel, wherein the driving module further comprises a digital to analog converter; wherein after the second interface receiver stores the interface data to the frame buffer, the digital to analog converter reads out the interface data in the frame buffer and converts it into an analog signal and transmits the analog signal to the display panel for display.

7. A display device comprising the self-refresh display driving device according to claim 1.

8. A method of driving a self-refresh display driving device comprising a self-refresh display driving device having a timing control module and a driving module, the method comprising:

when it is determined that a static image needs to be displayed, controlling the self-refresh display driving device to enter a self-refresh mode; and when the self-refresh display driving device enters the self-refresh mode, controlling the timing control module to enter a sleep mode, wherein the timing control module comprises a first interface receiver, a pixel formatter, a timing controller, and an interface transmitter, the timing control module turns off the first interface receiver, the pixel formatter and the interface transmitter when the self-refresh display driving device enters the self-refresh mode, wherein the driving module further includes a second interface receiver connected to the interface transmitter, when the frame buffer receives an enable signal of a first level, the second interface receiver receives interface data transmitted by the interface transmitter and stores it into the frame buffer, and wherein the driving module turns off the second interface receiver after the interface data is stored into the frame buffer, wherein when the self-refresh display driving device exits the self-refresh mode, the timing control module receives a waken-up signal and is wakened up and receives port data of a next frame, the port data is converted into interface data of a predetermined format and transmitted to the driving module, and meanwhile an enable signal of a second level is transmitted to the frame buffer to turn off the frame buffer.

9. The method according to claim 8, wherein the self-refresh display driving device is connected to a display control device; and when the self-refresh display driving device enters the self-refresh mode, after the display control device sends port data of a last frame to the first interface receiver, an interface main link is disconnected.

10. The method according to claim 9, wherein the pixel formatter is respectively connected to the first interface receiver and the interface transmitter, and is configured to convert the port data to interface data of a predetermined format.

11. The method according to claim 10, wherein while the interface transmitter transmits the interface data to the second interface receiver, the timing controller sends an enable signal of a first level to the frame buffer.

12. The method of claim 8, wherein the driving module is connected to a display panel, wherein the driving module further comprises a digital to analog converter;

wherein after the second interface receiver stores the interface data into the frame buffer, the digital to analog converter reads out the interface data in the frame buffer, converts it into an analog signal and transmits the analog signal to the display panel for display.

* * * * *